US010683613B2

(12) United States Patent
Likitalo

(10) Patent No.: US 10,683,613 B2
(45) Date of Patent: Jun. 16, 2020

(54) COMPOSITIONS FOR BLEACHING PULPS AND THEIR USE

(71) Applicant: ImerTech SAS, Paris (FR)

(72) Inventor: Mikko Likitalo, Waterloo (BE)

(73) Assignee: ImerTech SAS, Paris (FR)

( * ) Notice: Subject to any disclaimer, the term of this patent is extended or adjusted under 35 U.S.C. 154(b) by 658 days.

(21) Appl. No.: 14/896,317

(22) PCT Filed: Jun. 6, 2014

(86) PCT No.: PCT/EP2014/061878
§ 371 (c)(1),
(2) Date: Dec. 4, 2015

(87) PCT Pub. No.: WO2014/195478
PCT Pub. Date: Dec. 11, 2014

(65) Prior Publication Data

US 2016/0138219 A1 May 19, 2016

(30) Foreign Application Priority Data

Jun. 7, 2013 (GB) ..... 1310188.6

(51) Int. Cl.

| | |
|---|---|
| ***D21C 9/08*** | (2006.01) |
| ***D21H 21/02*** | (2006.01) |
| ***D21H 17/67*** | (2006.01) |
| ***D21H 17/69*** | (2006.01) |
| ***D21C 9/10*** | (2006.01) |
| ***D21C 9/16*** | (2006.01) |

(52) U.S. Cl.
CPC ..... *D21C 9/083* (2013.01); *D21C 9/08* (2013.01); *D21C 9/10* (2013.01); *D21C 9/163* (2013.01); *D21H 17/67* (2013.01); *D21H 17/69* (2013.01); *D21H 21/02* (2013.01)

(58) Field of Classification Search
CPC ..... D21C 9/08; D21C 9/083; D21C 9/086
See application file for complete search history.

(56) References Cited

U.S. PATENT DOCUMENTS

| | | | | |
|---|---|---|---|---|
| 3,882,232 | A * | 5/1975 | Pendergrast | A61K 33/06 424/688 |
| 4,184,912 | A | 1/1980 | Payton | |
| 4,482,542 | A * | 11/1984 | Schneider | C01F 7/34 424/682 |
| 4,927,465 | A | 5/1990 | Hyder et al. | |
| 5,580,931 | A * | 12/1996 | Aguirre | C08F 4/42 525/274 |
| 2003/0096143 | A1 | 5/2003 | Lasmarias et al. | |
| 2004/0116578 | A1* | 6/2004 | Imanishi | C08K 3/34 524/445 |
| 2009/0205795 | A1 | 8/2009 | Ni et al. | |

FOREIGN PATENT DOCUMENTS

| | | | |
|---|---|---|---|
| CN | 101105017 | A | 1/2001 |
| EP | 0040521 | A1 | 11/1981 |
| EP | 0 159 822 | A1 | 10/1985 |
| EP | 0 165 646 | A2 | 12/1985 |
| GB | 2 297 334 | A | 7/1996 |
| JP | S5580589 | | 6/1980 |
| JP | S55158394 | | 12/1980 |
| JP | S60200821 | | 10/1985 |
| JP | S63152493 | | 6/1988 |
| WO | WO 89/03863 | | 5/1989 |
| WO | WO 94/12725 | | 6/1994 |
| WO | WO 2005/121447 | A1 | 12/2005 |

OTHER PUBLICATIONS

International Search Report and Written Opinion dated Sep. 11, 2014, in International Application No. PCT/EP2014/061878.
Extended European Search Report for European Application No. 19174578.5 , dated Sep. 9, 2019. (9 pages).

* cited by examiner

*Primary Examiner* — Anthony Calandra
(74) *Attorney, Agent, or Firm* — Finnegan, Henderson, Farabow, Garrett & Dunner, LLP

(57) ABSTRACT

Compositions suitable for use in the bleaching of pulps may include one or more particulate alkaline earth metal oxides or alkaline earth metal hydroxides or mixtures thereof, and one or more pitch control additives. The compositions may be suitable for use in a pulp preparation or a papermaking process. A method for the bleaching of pulps may include providing the composition.

9 Claims, No Drawings

COMPOSITIONS FOR BLEACHING PULPS AND THEIR USE

CLAIM FOR PRIORITY

This application is a U.S. national phase entry under 35 U.S.C. § 371 from PCT International Application No. PCT/EP2014/061878, filed Jun. 6, 2014, which claims the benefit of priority of Great Britian Patent Application No. 1310188.6, filed Jun. 7, 2013, the subject matter of both of which is incorporated herein by reference.

FIELD OF THE INVENTION

The present invention relates to compositions suitable for use in the bleaching of pulps. In particular, the compositions are suitable for use as additives for adjustment of pH and/or control of the amount of unwanted substances within a pulp during a pulp bleaching step. Also related to the present invention is the use of said compositions, for example the use of said compositions in a pulp preparation or a papermaking process, as well as bleaching methods for pulps using said compositions.

BACKGROUND OF THE INVENTION

Traditional bleaching processes of pulps commonly employ alkaline hydrogen peroxide as a bleaching agent. To that effect, hydrogen peroxide and a water soluble alkaline compound, such as sodium hydroxide and/or water glass are introduced into the pulp in order to improve whiteness and/or brightness of a wood pulp, a recycled paper pulp or any other mechanical pulp, such as a pulp for papermaking processes. The use of chelating agents like EDTA to remove some of the metal ions from the pulp prior to adding peroxide allows the peroxide to be used more efficiently. Magnesium salts and sodium silicate may also be added to improve bleaching with alkaline peroxide.

WO 94/12725 A1 discloses the use of metal hydroxide-aluminium chloride mixtures as an alkaline agent in hydrogen peroxide bleaching of virgin wood pulps and recycled paper pulps.

More recently (for example as disclosed in Li et al., Pulp & Paper Canada 106:6 (2005), pages T125 to T129 "Using magnesium hydroxide ($Mg(OH)_2$) as the alkali source in peroxide bleaching at Irving paper") magnesium hydroxide $Mg(OH)_2$ and magnesium oxide MgO have been employed to replace sodium hydroxide and water glass, and to reduce the need for chelating agents and sodium silicate. Since magnesium hydroxide and alkaline earth metal hydroxides in general have limited solubility in water, only reduced amounts are discharged as waste water, making it economically and environmentally attractive to use. However, magnesium hydroxide is not used in a widespread manner due to issues with formation of deposits in the pulp resulting from the reaction of $Mg^{2+}$ ions with soluble and colloidal wood components, in particular magnesium fatty acid salts and resins. The presence of these deposits unfavourably affects paper machine runnability and paper mill productivity. These problems have prevented alkaline earth metal hydroxide assisted hydrogen peroxide bleaching to be employed more widely.

The problem of magnesium based fatty acid salts and resins in pulps has so far received little attention in the specialised literature. It is therefore an aim of the present invention to allow the widespread use of alkaline earth metal hydroxides or alkaline earth metal oxides in the bleaching of pulps.

SUMMARY OF THE INVENTION

The present invention is defined in the appended claims.

In certain embodiments, the present invention is embodied by a composition for use in bleaching of pulps, for example for use in bleaching of papermaking pulps, the composition comprising one or more particulate alkaline earth metal oxides or alkaline earth metal hydroxides or mixtures thereof and one or more pitch control additives. The pitch control additives may be selected from talc, bentonite, zeolite, diatomaceous earth, cationic mica, hydrophobic carbonates, resin-decomposing enzymes, cationic polymers designed to capture and immobilise resins or resinous components on fibre surfaces, aluminium sulphate, polyaluminium chloride, and dispersing agents specifically designed for the dispersion of resins and resinous components.

According to one embodiment of the invention, the particulate alkaline earth metal is selected from magnesium, calcium, or mixtures thereof. According to one embodiment of the invention, the pitch control additive is micronized talc. According to one embodiment of the invention, the pitch control additive is selected from bimodal talc and cationic talc.

Certain embodiments of the composition according to the present invention may be an aqueous slurry. According to one aspect, the slurries may have a solids content from 10 wt.-% to 75 wt.-% of the total slurry, such as from 25 wt.-% to 72 wt.-% of the total slurry, or from 35 wt.-% to 70 wt.-% of the total slurry, or from 45 wt.-% to 68 wt.-% of the total slurry, or from 50 wt.-% to 65 wt.-% of the total slurry, such as about 55 wt.-% of the total slurry.

Certain embodiments of the composition according to the present invention may be in the form of pellets. According to one aspect, the pellets may have a moisture content from 0.1 wt.-% to 35 wt.-%, based on the total weight of the composition. According to a further aspect, the pellets may comprise from 0.1 wt.-% to 50 wt.-% pitch control additive and from 99.9 wt.-% to 50 wt.-% particulate alkaline earth metal oxide or alkaline earth metal hydroxide or mixtures thereof, based on the total solids content of the pellets.

Certain embodiments of the composition according to the present invention may be in the form of spray-dried particulate compositions. According to one aspect, the said spray-dried composition may have a moisture content of 5 wt.-% or less, based on the total dry weight of the composition.

According to one embodiment, the particulate alkaline earth metal oxide or alkaline earth metal hydroxide is present in an amount ranging from 10 wt.-% to 90 wt.-%, and the pitch control additive present in an amount ranging from 90 wt.-% to 10 wt.-%, each on the basis of the total solids content of the composition. In one embodiment, the particulate alkaline earth metal oxide or alkaline earth metal hydroxide is present in an amount ranging from 30 wt.-% to 70 wt.-%, and the pitch control additive is present in an amount ranging from 70 wt.-% to 30 wt.-%, each on the basis of the total solids content of the composition. In one embodiment, the particulate alkaline earth metal oxide or alkaline earth metal hydroxide is present in an amount ranging from 40 wt.-% to 60 wt.-%, and the pitch control additive is present in an amount ranging from 60 wt.-% to 40 wt.-%, each on the basis of the total solids content of the composition. In one embodiment, the particulate alkaline earth metal oxide or alkaline earth metal hydroxide is present in an amount of 50 wt.-% on the basis of the total solids content of the composition. In one embodiment, the pitch control additive is present in an amount of 50 wt.-%, on the basis of the total solids content of the composition.

According to one embodiment of the present invention, the weight ratio of the particulate alkaline earth metal oxide or alkaline earth metal hydroxide compared to the said pitch control additive ranges from 9:1 to 1:9. In one embodiment, the weight ratio of the particulate alkaline earth metal oxide or alkaline earth metal hydroxide compared to the said pitch control additive ranges from 7:3 to 3:7. In one embodiment, the weight ratio of the particulate alkaline earth metal oxide or alkaline earth metal hydroxide compared to the said pitch control additive ranges from 6:4 to 4:6. In one embodiment, the weight ratio of the particulate alkaline earth metal oxide or alkaline earth metal hydroxide compared to the said pitch control additive is 1:1.

According to one embodiment, the composition may further comprise one or more of the following additives: dispersants; fillers; surfactants; bleaching agents; chelating agents; and pH-buffering agents.

The use of the composition according to certain embodiments of the present invention in a pulp preparation or a papermaking process is another aspect of the invention. In particular, bleaching methods for a pulp may comprise the step of providing a composition according to certain embodiments of the invention and adding it to the pulp in such an amount that the particulate alkaline earth metal oxide or alkaline earth metal hydroxide is present in the pulp in an amount ranging from 0.1 to 8 wt.-%, and that the pitch control additive is present in the pulp in an amount ranging from 0.1 to 8 wt.-%, each on the basis of the total solids content of the pulp after addition. According to one embodiment, the method further comprises the addition of one or more selected from hydrogen peroxide, water glass and a complexing agent to the pulp. According to certain embodiments of the invention, the composition may be added to the pulp during a bleaching step, or during a grinding step, or at any time between the grinding and the bleaching step.

It is understood that the following description and references to the figures concern exemplary embodiments of the present invention and shall not be limiting the scope of the claims.

DETAILED DESCRIPTION OF THE INVENTION

The present invention according to the appended claims provides compositions for use in bleaching of pulps, for example compositions for use in bleaching of papermaking pulps.

It has been found that a combination of alkaline earth metal hydroxide or alkaline earth metal oxide with one or more pitch control agents, when used as an alkaline additive in hydrogen peroxide bleaching of pulps, effectively reduces or eliminates the formation of harmful deposits in the pulp. According to certain embodiments of the present invention, the formation of harmful deposits in the pulp is reduced by 10% or more, such as by 30% or more, such as by 50% or more, or by 70% or more, for example by 90%. According to certain embodiments, the formation of harmful deposits in the pulp is reduced by more than 90%. According to certain embodiments of the present invention, the alkaline earth metal hydroxide or alkaline earth metal oxide on the one hand and the pitch control agents on the other hand are present in the composition as discrete particles. As used herein, the term "discrete particles" signifies that the particles are not dissolved (i.e., in solution) and/or not chemically or physically bound and may be separated from each other by purely mechanical methods.

The alkaline earth metal hydroxide or alkaline earth metal oxide may be selected from magnesium hydroxide, calcium hydroxide, magnesium oxide and calcium oxide, or mixtures thereof. If an alkaline earth metal oxide is used, this acts in the same way as an alkalinity agent by formation of the corresponding alkaline earth metal hydroxide in aqueous medium. These compounds have a low solubility in water and are therefore released into the pulp only at the rate they are being consumed during the bleaching process, therefore providing improved control of the pH of the pulp. During the bleaching process, the pH of the pulp may be 7 or higher, or ranging from 9 to 11.

In certain embodiments, the alkaline earth metal hydroxide may be magnesium hydroxide. In some embodiments, the magnesium hydroxide may be crystalline (e.g., brucite). In other embodiments, the magnesium hydroxide may be an amorphous form.

The pitch control agent for use in the composition according to certain embodiments of the present invention is preferably talc, a natural magnesium silicate with a platy structure. A combination of discrete talc and alkaline earth metal hydroxide or alkaline earth metal oxide particles for use in hydrogen peroxide bleaching has not been previously contemplated.

In one embodiment, the talc for use in the present invention may be present in combination with impurities, such as chlorite and/or carbonates. In one embodiment, the composition for use in bleaching pulps may further comprise impurities such as chlorite and/or carbonates.

In one embodiment, the talc for use in the present invention is micronised talc. Micronised talc is ground talc having a median particle diameter $d_{50}$, as measured in a Sedigraph, ranging from 0.5 μm to 15 μm. Preferably the micronized talc for use in the composition according to certain embodiments of the present invention has a median particle size $d_{50}$, ranging from 1.5 μm to 6.5 μm, more preferably from 2 μm to 4 μm, or from 2.0 μm to 4.0 μm.

Particle size characteristics described herein are measured via sedimentation of the particulate material in a fully dispersed condition in an aqueous medium using a Sedigraph 5100 particle size analyzer supplied by Micrometrics Instruments Corporation Norcross, Ga, USA. The term "$d_{50}$" as used herein refers to the median particle diameter and is the particle diameter at which 50% by weight of the product is larger and 50% by weight is smaller.

In one embodiment, the talc for use in the composition is bimodal talc. A bimodal talc as used herein is a particulate talc, wherein an envelope curve of size distribution of the particles obtained by sedimentation using a Sedigraph exhibits two distinct peaks. As used herein, the "envelope curve of particle size distribution" denotes the curve of size distribution of all the talc particles in a specific sample. For example, the envelope curve of particle size distribution of the talc contained in a composition according to certain embodiments of the present invention denotes the curve of size distribution of all the talc particles in the said composition. In one embodiment, the bimodal talc as used in the composition may have peaks in the envelope curve of particle size distribution located at any two of 0.2 μm, 0.5 μm, 1 μm, 2 μm, 3 μm, 4 μm, 5 μm, 6 μm, 7 μm, 8 μm, 9 μm, 10 μm, 11 μm, 12 μm, 13 μm, 14 μm, and 15 μm, or thereinbetween. For example, the bimodal talc as used herein may have peaks in the envelope curve of particle size distribution at 0.5 μm and 4 μm, or at 1 μm and at 6 μm. As defined herein, according to measurement uncertainties known to the skilled person, the peaks in the envelope curve of particle size distribution may be in the range of up to 100% above or below the given particle size, or for example, they may be in the range of 90% above or below the given particle size, or for example, they may be in the range of 80% above or below the given particle size, or for example, they may be in the range of 70% above or below the given particle size, or for example, they may be in the range of 60% above or below the given particle size, or for example, they may be in the range of 50% above or below the given particle size, or for example, they may be in the range of 40% above or below the given particle size, or for example, they may be in the range of 30% above or below the given particle size, or for example, they may be in the range of 20% above or below the given particle size, or for example, they may be in the range of 10% above or below the given particle size, or for example, they may be in the range of 5% above or below the given particle size.

In one embodiment a bimodal talc may have a particle size distribution such that the peaks in the envelope curve of particle size distribution have a relative size of from 9:1 to 1:9, for example a relative size of from 8:2 to 2:8, for example a relative size of from 7:3 to 3:7, for example a relative size of from 6:4 to 4:6, such as for example a relative size of about 1:1. The relative size of the peaks is defined as the ratio of the areas below the peaks.

In one embodiment according to the present invention, the talc for use in the composition is cationic talc. Cationic talc as used herein is talc, the surface of which has been pretreated with a cationic polymer (e.g. PolyDADMAC) to change the anionic zeta potential of untreated talc to a cationic zeta potential. In one embodiment, the cationic zeta potential of the talc for use in the composition according to the present invention is 10 mV or above, such as for example 20 mV or above.

According to certain embodiments of the present invention, the composition for use in bleaching of pulps may be present as an aqueous slurry. Aqueous slurries are commonly used, for example in papermaking, for introducing solids into a pulp. As such, a composition according to certain embodiments of the present invention in the form of an aqueous slurry may be introduced into the pulp in order to support hydrogen peroxide bleaching. By putting certain embodiments of the composition of the present invention in the form of a slurry, the overall weight of the composition is increased. In order to limit the weight increase, for example to maintain efficiency in transportation of the compositions, it is preferred that the aqueous slurries comprising the composition according to certain embodiments of the present invention have a solids content of 10 wt.-% or higher, on the basis of the total weight of the slurry, such as 30 wt.-% or higher, or 30 wt.-% or higher, or 40 wt.-% or higher, or 45 wt.-% or higher, or 50 wt.-% or higher, or even 60 wt-% or higher, such as up to 70 wt.-%, or 72 wt.-%, or 75 wt.-%. In order to achieve high solids content slurries, it may be necessary to include dispersants in the slurry. The slurries may also comprise further components such as fillers, surfactants, bleaching agents, pH-buffering agents, or other additives.

In certain embodiments, the composition has the form of dry particulate powders. In order to reduce weight of the composition and to improve transportability, the compositions may be transported as dry powders and slurries be formed only at the site of use of the compositions in a bleaching process. The said dry particulate powders may be obtained, for example, by use of a spray-drying process. Spray-dried particulate compositions according to certain aspects of the present invention may have a low or a very low moisture content, such as for example 5 wt.-% moisture or less, based on the total amount of solids in the spray-dried particulate powder, or 4 wt-% moisture or less, or 3 wt.-% moisture or less, or even 2 wt.-% moisture or less, such as for example about 1 wt.-% moisture or 0.5 wt.-% moisture. The dry compositions may also comprise further components such as dispersants, fillers, surfactants, bleaching agents, chelating agents, pH-buffering agents, or other additives.

In certain embodiments, the composition is in the form of pellets. According to one aspect, the pellets may have a moisture content from 0.1 wt.-% to 25 wt.-%, based on the total weight of the composition, such as for example from 2 wt.-% to 20 wt.-% or from 5 wt.-% to 15 wt.-%, such as for example about 15 wt.-%. According to a further aspect, the pellets may comprise from 2 wt.-% to 50 wt.-% pitch control additive and from 98 wt.-% to 50 wt.-% particulate alkaline earth metal oxide or alkaline earth metal hydroxide or mixtures thereof, based on the total solids content of the pellets.

For example, in one embodiment, the composition may be in the form of magnesium hydroxide/talc-pellets comprising 87.5 wt.-% magnesium hydroxide and 12.5 wt.-% talc, each based on the total solids content of the pellet.

According to certain embodiments of the present invention, the compositions for use in bleaching of pulps may comprise the particulate alkaline earth metal oxides or alkaline earth metal hydroxides and the pitch control additives in a weight ratio ranging from 1:9 to 9:1, such as for example between 3:7 and 7:3, such as for example ranging from 2:3 to 3:2, for example at a weight ratio of 1:2, or 1:1, or 2:1.

According to certain embodiments of the present invention, the compositions for use in bleaching of pulps may comprise the one or more particulate alkaline earth metal oxides or alkaline earth metal hydroxides in an amount of 10 wt.-% to 90 wt.-% of the total solids content of the composition, such as for example in an amount of 30 wt.-% to 70 wt.-% of the total solids content of the composition, such as for example in an amount of 40 wt.-% to 60 wt.-% of the total solids content of the composition, such as for example in an amount of 50 wt.-% of the total solids content of the composition.

According to certain embodiments of the present invention, the compositions for use in bleaching of pulps may comprise one or more pitch control additives in an amount of 10 wt.-% to 90 wt.-% of the total solids content of the composition, such as for example in an amount of 30 wt.-% to 70 wt.-% of the total solids content of the composition, such as for example in an amount of 40 wt.-% to 60 wt.-% of the total solids content of the composition, such as for example in an amount of 50 wt.-% of the total solids content of the composition.

Another aspect of the present invention is the use of the compositions according to certain embodiments of the present invention in the bleaching process of pulps, such as in the bleaching process of pulps for papermaking. For example, the compositions according to certain embodiments of the present invention may be used in combination with other additives such as hydrogen peroxide, complexing agents, water glass, or others, in a bleaching process of pulp in a paper making process.

The compositions according to the present invention may fully or partially replace known alkaline compositions, such as NaOH. For example, NaOH may be fully omitted as the alkaline agent in a $H_2O_2$-bleaching process, or the amount of NaOH may be reduced by simultaneous addition of a composition according to the present invention.

According to certain embodiments of the present invention, it is not required that the one or more particulate alkaline earth metal oxides or alkaline earth metal hydroxides or mixtures thereof on the one hand, and the one or more pitch control additives on the other hand, be mixed together prior to being introduced into a pulp to be bleached. An additional aspect of the present invention is the use of a composition obtained by separately introducing the components of a composition into a papermaking pulp, thereby forming the composition within a pulp during the bleaching of said pulp.

In the bleaching process, the composition according to certain embodiments of the present invention is introduced into the pulp in such an amount that the amount of the one or more particulate alkaline earth metal oxides or alkaline earth metal hydroxides or mixtures thereof in the pulp is from 0.1 wt.-% to 8 wt.-% of the total solids content of the pulp during the bleaching, such as from 0.2 wt.-% to 4 wt.-% of the total solids content of the pulp during the bleaching, such as from 0.5 wt.-% to 2.5 wt.-% of the total solids content of the pulp, such as for example 1 wt.-% or 2 wt.-% of the total solids content of the pulp, and that the amount of the one or more pitch control additives in the pulp is from 0.1 wt.-% to 8 wt.-% of the total solids content of the pulp during the bleaching, such as from 0.2 wt.-% to 4 wt.-% of the total solids content of the pulp during the bleaching, such as from 0.5 wt.-% to 2.5 wt.-% of the total solids content of the pulp, such as for example about 1 wt.-% or about 2 wt.-% of the total solids content of the pulp.

According to certain embodiments of the present invention, the composition for use in bleaching of a papermaking pulp may be included in said pulp for example during the bleaching stage, or at the beginning of the bleaching stage, or prior to the bleaching stage. For example, the composition for use in bleaching of a papermaking pulp may be included in said pulp as early as the grinding stage during which the pulp components are ground, or at any time between the grinding stage and the bleaching stage. The various components of the composition according to certain embodiments of the present invention may also be added to the papermaking pulp at separate stages, such as for example addition of the one or more pitch control agents during the grinding stage and addition of the one or more particulate alkaline earth metal oxides or alkaline earth metal hydroxides or mixtures thereof during or just prior initiation of the bleaching step, or vice-versa.

EXAMPLES

The inventors have conducted a series of tests in order to demonstrate the efficiency of the composition according to the present invention in pulp bleaching, and to investigate the effect of the composition according to the present invention on deposit control.

In Examples 1, 2 and 3, hydrogen peroxide was used as 30% active content; NaOH was used as a concentrated aqueous solution; $Mg(OH)_2$ was used as a dry powder; DTPA was used as a 50% active content solution; sodium silicate (water glass) was used in its liquid aqueous form, of commercial quality. The talc employed had a mean particle size $d_{50}$ of 3.5 μm as measured by Sedigraph. The heating was carried out in a water bath at up to 90° C. The measurement of residual peroxide was carried out using standard iodometric $H_2O_2$-titration, for example as known from http://www.h2o2.com/technical-library/analytical-methods/default.apsx?pid=70&name=Idometric-Titration. Brightness, yellowness and Chemical oxygen demand (COD) were measured using standard procedures: Brightness and yellowness were measured using ISO method 2470 in combination with TAPPI method T 218 sp-02 for sheet preparation. The Chemical oxygen demand (COD) was measured using a Hach-Lange Testkit and method LCK314 in combination with rapid heating block HT 200S.

Example 1

Bleaching Tests and Waste Water Quality for Medium Bleaching Level

Mechanical pulp samples (35 g dry weight) were bleached at 80° C. for 150 minutes, using 2.0% hydrogen peroxide and 0.30% DTPA in the presence of variable amounts of NaOH, $Mg(OH)_2$, talc, and water glass. The amounts of added water was always adjusted to obtain a 30% solids content in the pulp. The bleaching consistency was set to 30%. The compositions used for bleaching to a medium level are listed in Table I:

TABLE I

| | Comp. 1a | Comp. 1b | Comp. 1c | Example 1 |
|---|---|---|---|---|
| NaOH | 1.4% | — | 0.7% | — |
| $Mg(OH)_2$ | — | 1.0% | 0.5% | 1.0% |
| water glass | 1.5% | 0.5% | 0.5% | 0.5% |
| DTPA | 0.3% | 0.3% | 0.3% | 0.3% |
| talc | — | — | — | 1.0% |

Samples were taken from the bleaching mixtures after 75 and 150 minutes. The samples were analysed for Brightness (% ISO) and Yellowness (%) to assess the bleaching efficiency, and for residual peroxide (%) and COD (kg/t) to assess the waste water quality. The results for an unbleached pulp sample ("Unbl.") are also shown. The results are shown in Table II:

TABLE II

| | Unbl. | Comp. 1a | | Comp. 1b | | Comp. 1c | | Example 1 | |
|---|---|---|---|---|---|---|---|---|---|
| Sample (min) | — | 75 | 150 | 75 | 150 | 75 | 150 | 75 | 150 |
| Brightness (% ISO) | 72.0 | 80.00 | 79.43 | 79.08 | 80.04 | 79.83 | 80.00 | 78.75 | 79.63 |
| Yellowness (%) | 16.5 | 12.38 | 12.89 | 12.95 | 12.77 | 12.70 | 12.80 | 12.75 | 12.51 |
| Res. peroxide (%) | 0 | 35.14 | 33.40 | 54.33 | 44.03 | 40.41 | 36.57 | 52.00 | 40.19 |
| COD (kg/t) | 11 | 46.68 | | 34.63 | | 35.35 | | 34.61 | |

The tests show that for medium bleaching levels, equivalent levels of colour and brightness are achievable when NaOH is replaced by a composition according to the present invention. The presence of talc as a pitching agent has no negative influence on the bleaching performance. Furthermore, COD levels are 11 to 13 kg/t lower, showing improved waste water quality, and residual peroxide is about 30% higher, which allows peroxide saving.

Example 2

Bleaching Tests and Waste Water Quality for Medium Bleaching Level

Mechanical pulp samples (35 g dry weight) were bleached at 80° C. for 150 minutes, using 3.5% hydrogen peroxide and 0.30% DTPA in the presence of variable amounts of NaOH, $Mg(OH)_2$, talc, and water glass. The amounts of added water was always adjusted to obtain a 30% solids content in the pulp. The bleaching consistency was set to 30%. The compositions used for bleaching to a medium level are listed in Table III:

TABLE II

| | Comp. 2a | Comp. 2b | Comp. 2c | Ex. 2a |
|---|---|---|---|---|
| NaOH | 2.45% | — | 1.25% | 1.25% |
| $Mg(OH)_2$ | — | 1.7% | 0.85% | 0.85% |
| water glass | 2.0% | 0.5% | 0.5% | 0.5% |
| DTPA | 0.3% | 0.3% | 0.3% | 0.3% |
| talc | — | — | — | 1.0% |

Samples were taken from the bleaching mixtures after 75 and 150 minutes. The samples were analysed for Brightness (% ISO) and Yellowness (%) to assess the bleaching efficiency, and for residual peroxide (%) and COD (kg/t) to assess the waste water quality. The results for an unbleached pulp sample ("Unbl.") are also shown. The results are shown in Table IV:

TABLE IV

| | Unbl. | Comp. 2a | | Comp. 2b | | Comp. 2c | | Example 2a | |
|---|---|---|---|---|---|---|---|---|---|
| Sample (min) | — | 75 | 150 | 75 | 150 | 75 | 150 | 75 | 150 |
| Brightness (% ISO) | 72.0 | 82.06 | 82.41 | 80.79 | 81.25 | 81.55 | 82.28 | 81.29 | 81.65 |
| Yellowness (%) | 16.5 | 10.89 | 10.86 | 11.77 | 11.67 | 11.27 | 10.96 | 11.03 | 10.97 |
| Res. peroxide (%) | 0 | 31.06 | 26.84 | 44.87 | 36.68 | 39.63 | 35.60 | 38.20 | 30.83 |
| COD (kg/t) | 11 | 60.90 | | 40.93 | | 50.70 | | 47.75 | |

The tests show that the compositions according to the present invention lead to an approximately 1% drop in brightness, if NaOH is fully substituted. However, a partial (half) replacement of NaOH by a composition according to the present invention gives equivalent bleaching results, better remaining peroxide and lower COD level. COD levels are about 14 kg/t lower, showing improved waste water quality.

Example 3

Reduction of Silicate (Water Glass) Levels

Mechanical pulp samples (35 g dry weight) were bleached at 80° C. for 150 minutes, using 3.5% hydrogen peroxide and 0.30% DTPA in the presence of variable amounts of NaOH, $Mg(OH)_2$, talc, and water glass, in the same way as in Example 2. Reduction of silicate (water glass) in the bleaching composition was tested. The compositions used for bleaching to a medium level are listed in Table V:

TABLE V

| | Comp. 2c | Ex. 3a |
|---|---|---|
| NaOH | 1.25% | 1.25% |
| $Mg(OH)_2$ | 0.85% | 0.85% |
| water glass | 0.5% | 0.25% |
| DTPA | 0.3% | 0.3% |
| talc | — | 1.0% |

Samples were taken from the bleaching mixtures after 75 and 150 minutes. The samples were analysed for Brightness (% ISO) and Yellowness (%) to assess the bleaching efficiency, and for residual peroxide (%) and COD (kg/t) to assess the waste water quality. The results for an unbleached pulp sample ("Unbl.") are also shown. The results are shown in Table VI:

TABLE VI

| | Unbl. | Comp. 2c | | Example 3 | |
|---|---|---|---|---|---|
| Sample (min) | — | 75 | 150 | 75 | 150 |
| Brightness (% ISO) | 72.0 | 81.55 | 82.28 | 81.05 | 81.40 |
| Yellowness (%) | 16.5 | 11.27 | 10.96 | 11.20 | 11.20 |
| Res. peroxide (%) | 0 | 39.63 | 35.60 | 35.33 | 26.12 |
| COD (kg/t) | 11 | 50.70 | | 47.62 | |

The tests show that reduction of silicate in the bleaching process slightly deteriorates bleaching efficiency, but still leads to acceptable results, when a composition according to the present invention is used. The use of lower silicate levels in the bleaching process has a positive influence on anionic trash levels and improves machine runnability.

Example 4

Deposit Control

The effect of $Mg(OH)_2$ and talc on the tendency for resin deposit was tested. The test was carried out according to the Gustafsson Method. Reactive additives (talc, NaOH, $Mg(OH_2)$) are added to a 2% aqueous fibre dispersion in an aluminium cup and mixed for 10 minutes using Gustafsson's machine, an overhead stirrer with copper rotors. Then a resin, dissolved in acetone is added, the resulting mixture is mixed for a further 30 minutes and the recipient is rinsed with water. The resin deposits are extracted with acetone, the acetone is evaporated and the weight of the resin deposit is measured.

The test was carried out in the presence of talc, NaOH and $Mg(OH)_2$ in various proportions. The results are shown in Table VII:

TABLE VII

| | Comp. 4a | Comp. 4b | Comp. 4c | Comp. 4d | Ex. 4 |
|---|---|---|---|---|---|
| Talc | — | 2.0% | — | — | 2.0% |
| NaOH | — | — | 0.2% | — | — |
| $Mg(OH)_2$ | — | — | — | 2.0% | 2.0% |
| Deposit | 34 mg | 20 mg | 15 mg | 26 mg | 18 mg |

The test clearly shows that a mixture of $Mg(OH)_2$ and talc leads to reduced resin deposits, similar to those obtained when NaOH is used. This shows that the problem known from the state of the art, of resin deposition in pulp during bleaching, can be solved by adding a pitch control agent, such as talc, to an alkaline earth metal oxides or hydroxide as the alkaline agent in $H_2O_2$-bleaching.

Example 5

Granulation of $Mg(OH)_2$

Various slurries comprising stabilised $Mg(OH)_2$ and talc were subjected to granulation in a standard pelletiser according to methods known to the skilled person in the art. The slurries had a solids content of 54 wt.-%, were dried in stainless steel containers and powdered and re-humidified using a Henschel mixer.

The obtained pelletised compositions are shown in Table VIII:

TABLE VIII

| Ratio $Mg(OH)_2$ (wt.-%) | Ratio talc (wt.-%) | Solid content prior to pelletisation | Solid content after pelletisation | Difference |
|---|---|---|---|---|
| 50 | 50 | 93.1 wt.-% | 94.6 wt.-% | 1.3 |
| 50 | 50 | 88.6 wt.-% | 89.3 wt.-% | 0.7 |
| 75 | 25 | 85.0 wt.-% | 86.7 wt.-% | 1.7 |
| 87.5 | 12.5 | 86.5 wt.-% | 86.7 wt.-% | 0.2 |

The listed solids contents are in respect to the total amount of material prior to and after pelletisation. It was found that in the case of the 1:1 (weight) $Mg(OH)_2$/talc compositions, the formulation comprising more water lead to pellets with improved adherence and stability. It was further found that, compared to pellets comprising only 100 wt.-% $Mg(OH)_2$ (solids content), less energy was required to perform pelletisation.

ADDITIONAL DISCLOSURE

Clause A: Also disclosed herein is a composition for use in bleaching of pulps, the composition comprising (a) one or more particulate alkaline earth metal oxides or alkaline earth metal hydroxides or mixtures thereof; and (b) one or more pitch control additives.

Clause B: Also disclosed herein is a composition according to Clause A, wherein said pitch control additive is selected from talc, bentonite, zeolite, diatomaceous earth, cationic mica, hydrophobic carbonates, resin-decomposing enzymes, cationic polymers designed to capture and immobilise resins or resinous components on fibre surfaces, aluminium sulphate, polyaluminium chloride, and dispersing agents specifically designed for the dispersion of resins and resinous components, and mixtures thereof.

Clause C: Also disclosed herein is a composition according any of the Clauses A and B, wherein the alkaline earth metal in the said particulate alkaline earth metal oxides or alkaline earth metal hydroxides or mixtures thereof is selected from magnesium, calcium, and mixtures thereof.

Clause D: Also disclosed herein is a composition according to any of the Clauses A to C, wherein said pitch control additive is selected from micronized talc, bimodal talc, and cationic talc.

Clause E: Also disclosed herein is a composition according to any of the Clauses A to D which is an aqueous slurry.

Clause F: Also disclosed herein is a composition according to Clause E, wherein said aqueous slurry has a total solids content of from 10 to 75 wt.-%, on the basis of the total weight of the slurry.

Clause G: Also disclosed herein is a composition according to any one of Clauses A to D which is in a pelletised form.

Clause H: Also disclosed herein is a composition according to any one of Clauses A to D which is a spray-dried particulate composition.

Clause I: Also disclosed herein is a composition according to any of the Clauses A to H, wherein the content of the said particulate alkaline earth metal oxide or alkaline earth metal hydroxide ranges from 10 wt.-% to 90 wt.-%, and the content of the said pitch control additive ranges from 90 wt.-% to 10 wt.-%, each on the basis of the total solids content of the composition.

Clause J: Also disclosed herein is a composition according to any of the Clauses A to I, wherein the weight ratio of the said particulate alkaline earth metal oxide or alkaline earth metal hydroxide compared to the said pitch control additive ranges from 9:1 to 1:9.

Clause K: Also disclosed herein is a composition according to any of Clauses A to J, further comprising at least one of the following additives: (a) dispersants; (b) fillers; (c) surfactants; (d) bleaching agents; (e) chelating agents; and (f) pH-buffering agents.

Clause L: Also disclosed herein is a use of the composition of any of the Clauses A to K in a pulp preparation or a papermaking process.

Clause M: Also disclosed herein is a method of bleaching a pulp, comprising the step of providing a composition of any one of Clauses A to K and the step of mixing said composition with the said pulp in such an amount that the said particulate alkaline earth metal oxide or alkaline earth metal hydroxide is present in the said pulp in an amount ranging from 0.2 to 4 wt.-%, and that said pitch control additive is present in the said pulp in an amount ranging from 0.2 to 4 wt.-%, each on the basis of the total solids content of the said pulp.

Clause N: Also disclosed herein is a method according to Clause M, further comprising the addition of one or more of hydrogen peroxide, water glass and a complexing agent to said pulp.

Clause O: Also disclosed herein is a method according to Clause M or Clause N, wherein the said composition is added to the said pulp during the bleaching step, or during the grinding step, or between the grinding and the bleaching step.

Clause P: Also disclosed herein is a method according to any one of Clauses M to O, wherein the step of providing a composition of any one of Clauses A to K comprises the sub-steps of (a) providing one or more particulate alkaline earth metal oxides or alkaline earth metal hydroxides or mixtures thereof; (b) providing one or more pitch control additives; and (c) adding the compositions obtained from sub-steps (a) and (b) separately to the said pulp.

Clause Q: Also disclosed herein is a method according to any one of Clauses M to P, wherein said method of bleaching a pulp is a method of bleaching a pulp for papermaking

The invention claimed is:

1. A composition for use in bleaching of pulps, the composition comprising:

(a) one or more particulate alkaline earth metal oxides or alkaline earth metal hydroxides or mixtures thereof; and (b) a talc pitch control additive and, optionally, one or more pitch control additives selected from zeolite, diatomaceous earth, cationic mica, hydrophobic carbonates, resin-decomposing enzymes, cationic polymers, aluminium sulphate, polyaluminium chloride, dispersing agents, and mixtures thereof, wherein the composition is an aqueous slurry having a total solids content of 10 wt.-% to 75 wt.-% on the basis of the total weight of the slurry, wherein the weight ratio of the particulate alkaline earth metal oxide or alkaline earth metal hydroxide compared to the talc pitch control additive ranges from 9:1 to 1:9, and wherein the talc pitch control additive is selected from micronized talc, bimodal talc, and cationic talc.

2. The composition according to claim 1, wherein the particulate alkaline earth metal is selected from magnesium, calcium, and mixtures thereof.

3. The composition according to claim 1, wherein the content of the particulate alkaline earth metal oxide or alkaline earth metal hydroxide ranges from 10 wt.-% to 90 wt.-%, and the content of the pitch control additive ranges from 90 wt.-% to 10 wt.-%, each on the basis of the total solids content of the composition.

4. The composition according to claim 1, further comprising at least one of the following additives: (a) dispersants; (b) fillers; (c) surfactants; (d) bleaching agents; (e) chelating agents; and (f) pH-buffering agents.

5. A method of bleaching a pulp, the method comprising providing a composition according to claim 1 and mixing said composition with the pulp in such an amount that the particulate alkaline earth metal oxide or alkaline earth metal hydroxide is present in the pulp in an amount ranging from 0.2 to 4 wt.-%, and that said pitch control additive is present in the pulp in an amount ranging from 0.2 to 4 wt.-%, each on the basis of the total solids content of the pulp.

6. The method according to claim 5, further comprising the addition of one or more of hydrogen peroxide, water glass, and a complexing agent to said pulp.

7. The method according to claim 5, wherein the composition is added to the pulp during the bleaching step, or during the grinding step, or between the grinding and the bleaching step.

8. The method according to claim 5, wherein providing the composition comprises sub-steps of (a) providing one or more particulate alkaline earth metal oxides or alkaline earth metal hydroxides or mixtures thereof;

(b) providing one or more pitch control additives; and (c) adding the compositions obtained from sub-steps (a) and (b) separately to the said pulp.

9. The method according to claim 5, wherein said method of bleaching a pulp is a method of bleaching a pulp for papermaking.

* * * * *